US006212797B1

(12) United States Patent
Merry et al.

(10) Patent No.: US 6,212,797 B1
(45) **Date of Patent: *Apr. 10, 2001**

(54) FOOTWEAR WITH DETACHABLE SPAT

(76) Inventors: David Merry, 31 Old Orchard Grove, Toronto, Ontario (CA), M5M 2C8; William H. Boorne, 9 Camforth Drive, Markham, Ontario (CA), L3R 7W2; Mitchell Fenton, 130 Glen Manor Drive, Toronto, Ontario (CA), M4R 2X6

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/332,943

(22) Filed: Jun. 15, 1999

(51) Int. Cl.[7] ..... A43B 3/24
(52) U.S. Cl. ..... 36/101; 36/127; 36/54
(58) Field of Search ..... 36/101, 136, 100, 36/127, 54

(56) References Cited

U.S. PATENT DOCUMENTS

| | | | |
|---|---|---|---|
| 2,261,125 | | 11/1941 | McFeely . |
| 2,801,477 | | 8/1957 | Adams et al. . |
| 3,032,896 | | 5/1962 | Weaver . |
| 3,196,559 | | 7/1965 | Thompson . |
| 3,306,610 | | 2/1967 | Biggs et al. . |
| 3,494,053 | | 2/1970 | Kennedy . |
| 3,601,909 | * | 8/1971 | Amendola . |
| 3,955,293 | | 5/1976 | Benedict . |
| 3,994,080 | | 11/1976 | Flangan et al. . |
| 4,333,248 | * | 6/1982 | Samuels . |
| 4,377,042 | * | 3/1983 | Bauer . |
| 4,510,699 | * | 4/1985 | Nakamura et al. . |
| 4,697,362 | * | 10/1987 | Wasserman . |
| 4,805,321 | * | 2/1989 | Tonkel . |
| 5,544,430 | * | 8/1996 | Jacko . |
| 5,778,564 | * | 7/1998 | Kettner . |

* cited by examiner

*Primary Examiner*—Ted Kavanaugh
(74) *Attorney, Agent, or Firm*—Evenson, McKeown, Edwards & Lenahan, P.L.L.C.

(57) ABSTRACT

Footwear having a removable spat-type feature. This feature allows the wearer to remove and replace the spat. The advantage is that it allows the use of different color, design or material spats to color coordinate the footwear with different colored clothes. This feature is of particular benefit when traveling since one pair of shoes with different colored saddles can accommodate a varied holiday wardrobe. In addition, other types of symbols or trademarks may be placed on the spat. The spat my depict indicia indicating membership to a club or other association. The spat and/or the upper may be provided with eyelets for securing the footwear on the wearer. The footwear has a first attachment media sewn into an upper at a level such that when the spat is placed on the upper, upper surfaces of the spat and the upper are substantially flush. The spat is provided with a second attachment media that corresponds to the first attachment media and covers substantially the entire spat so that when the spat is positioned on the upper, the spat is securely fastened thereto. Additional securing mechanisms may also be provided on the spat and upper.

20 Claims, 4 Drawing Sheets

FOOTWEAR WITH DETACHABLE SPAT

BACKGROUND OF THE INVENTION

1. Field of the Invention

The present invention relates to footwear, such as a shoe or boot having a saddle or spat region over the upper front thereof. More particularly, the present invention is directed to a removable saddle or spat for a shoe, such as a golf shoe, that can be attached to the shoe upper in a very secure, yet functional and comfortable manner.

2. Description of Related Art

Footwear, especially athletic footwear, such as golf shoes, are becoming more and more desirable for players. In a broader sense, the expense of obtaining shoes for the athletically minded individual is great. A different pair of shoes is required for golf, soccer, running, walking, cycling, bowling, boating and other sport and leisure activities. In addition, golfers for instance, also wear a wide variety of color coordinated clothes, for which many different style and color golf shoes may be required. It would be advantageous to provide a golf shoe wherein a single pair of shoes could be altered by the wearer thus creating the equivalent of many different colored pairs of shoes. For example, the color of an upper part of the shoe or the saddle could be changed to a different color by the wearer to coordinate with other attire.

There is known in the prior art removable or exchangeable spat sections for shoes. For example, U.S. Pat. No. 3,994,080 to Flanagan Jr. et al. discloses a shoe having a saddle area that can be removed and exchanged for a different color saddle. The saddle is held on the shoe by a series of snaps. A similar arrangement is found in U.S. Pat. No. 3,955,293 to Benedict. However, the attachment or fastener means for these types of shoes generally requires the use of snaps or guides which are difficult to use and are bulky and unsightly. In addition, the known types of removable spats use snaps or rails to attach the spat to the shoe. These attachment mechanisms are difficult to use, require a lot of time and manipulation, and because the attachment points are fixed, they generally can not accommodate feet of different widths very well. In addition, because the attachment mechanism is confined to an edge area of the spat, the spat may not be securely fastened to the shoe over its entire surface allowing debris to collect under the spat.

SUMMARY OF THE INVENTION

It is therefore an object of the present invention to provide a removable spat/saddle for footwear that avoids the above described disadvantages. The present invention is directed to a removable spat-type feature disposed on the top of the shoe. This feature allows the wearer to remove and replace the spat with a different spat. The advantage is that different color and/or material spats may be placed on the shoe to color coordinate with other clothes. In addition, other types of symbols or trademarks may be placed on the spat. For example, the spat may depict indicia indicating membership to a club or other association.

To obtain these and other advantages, one aspect of the present invention is to provide footwear having a removable spat wherein the footwear is generally in the shape of a shoe, particularly a golf shoe. The shoe has an upper portion and a rear portion, the upper portion having a tongue groove formed therein. The upper portion is provided with a spat area having a first attachment media connected thereto over the entire spat area. Similarly, the removable spat has a front side and a rear side, the rear side having a second attachment media such that when the spat is placed on the spat area of the upper portion, the first and second attachment media are overlaid and maintain the spat on the shoe.

The first and second attachment media are preferably a loop and hook-type material, such as VELCRO. However, other types of reusable adhesive-type material could also be used. In addition, eyelets for shoelaces are provided in the spat, the upper or both. Additional securing snaps or other types of fasteners may be provided on corresponding portions of the spat and the spat area.

The advantages to the present invention over the prior art are numerous. The shoe and one or more spats can be sold together and additional spats could be sold separately. The separately sold spat would be less expensive than the purchase of a new pair of shoes. In addition, because the attachment media covers all or substantially all of the spat and associated spat area on the upper, a more secure attachment is provided as opposed to the prior art edge attachment devices. In addition, the VELCRQ attachment media gives the wearer the flexibility to position the spat on the upper in such a way that it can be laced up to the exact tension that results in a comfortable fit and thereby accommodate feet of different widths.

In a shoe according to the present invention, the tongue may be part of the spat forming a single removable piece, or be attached to the upper resulting in two removable pieces. In the latter case, the first attachment media would be provided on the upper portion of the tongue.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof which makes reference to the annexed drawings wherein.

DETAILED DESCRIPTION OF THE DRAWINGS

Figure 1:
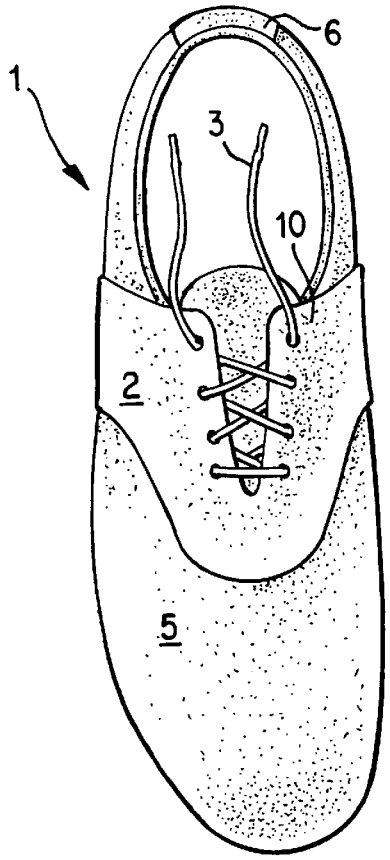
FIG. 1 is a top view of a shoe and removable spat according to the present invention.
Figure 2:
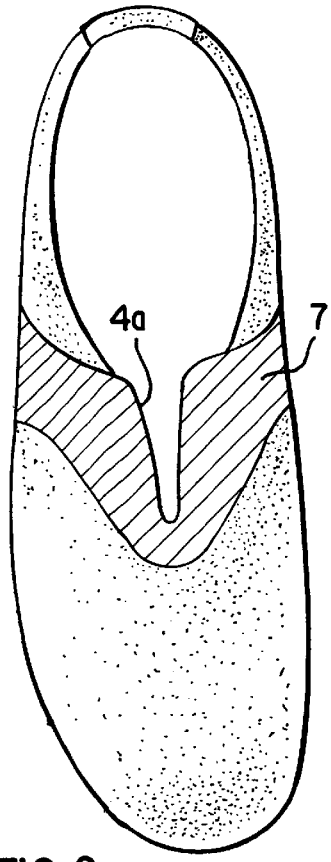
FIG. 2 is a top view of the shoe with the spat removed.

The present invention will now be described in greater detail with reference to the drawings, wherein FIG. 1 illustrates a first embodiment according to the present invention. As shown in FIG. 1, a shoe 1, more particularly a golf shoe, has an upper portion 5 and a rear portion 6. A removable spat 2 is positioned transversely across the upper portion 5. As illustrated in FIG. 2, upper portion 5 has a spat area 7 with a tongue groove 4*a*. Spat area 7 is formed of a first attachment media and is preferably stitched onto upper portion 5. Spat area 7 is preferably positioned such that the upper surface thereof is slightly below the adjacent section of upper 5. This ensures that when spat 2 is placed on spat area 7, the edge of spat 2 and upper 5 are substantially flush. This improves the aesthetic appearance of the shoe. The first attachment media is preferably a loop and hook material, such as VELCRO. However, other types of attachment media could also be used as long as the first attachment media covers a substantial portion of spat area 7.

Figure 3A:
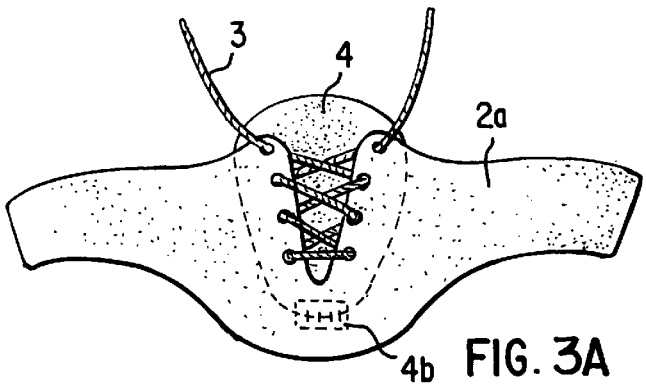
FIG. 3A is a top view of the front side of the removable spat.
Figure 3B:
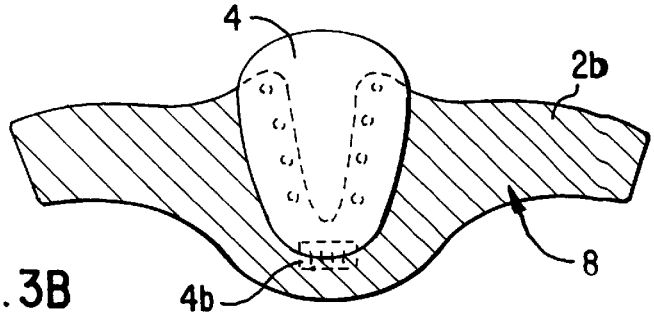
FIG. 3B is a top view of the back side of the removable spat.

FIGS. 3A and 3B illustrate a first embodiment of the removable spat 2 according to the present invention. Spat 2 is provided with a plurality of eyelets 10 for shoelaces 3. Spat 2 has a front side 2*a* and a back side 2*b*. Front side 2*a* of spat 2 can be provided with any type of desired color or symbol arrangement. Spat 2 also has a plurality of eyelets 3 formed therein and a tongue 4 attached thereto at tongue attachment point 4*b*. Tongue 4 is preferably stitched onto backside 2*b* of spat 2 or attached in some other manner, such as with adhesives, snaps, VELCRO or some combination thereof. eyelets 10 are provided on spat 2 rather than upper 5. This permits a much simpler replacement spat 2 because there is no need to align eyelets on the spat and upper.

As seen in FIG. 3B, back side 2*b* of spat 2 is 20 substantially covered by a second attachment media 8. Second attachment media 8 preferably corresponds to first attachment media on spat area 7 such that when spat 2 is placed over spat area 7, the first and second attachment media provide a secure attachment of the spat 2 to the upper portion 5. This is important because eyelets 10 for shoelace 3 are not attached to upper 5. As shoelace 3 is pulled tight, it will impart a tangential force across the mating surfaces of spat 2 and spat area 7. This force may induce spat 2 to pull away from spat area 7 if the attachment media were only provided around the periphery of spat 2. Because the first and second attachment media is provided over substantially the entire area of spat area 7 and backside 2*b* of spat 2, this force is countered and spat 2 remains securely fastened to upper 5 after shoelace 3 is pulled taught.

Because the respective backside 2*b* and spat area 7 are substantially covered with attachment media 7 and 8, such as VELCRO, spat 2 is securely maintained on upper 5. Thus, spat 2 is securely fastened over substantially its entire area to upper 5. This also ensures that edges of spat 2 do not fold outwardly, producing an aesthetically unpleasing look to the shoe.

Figure 4:
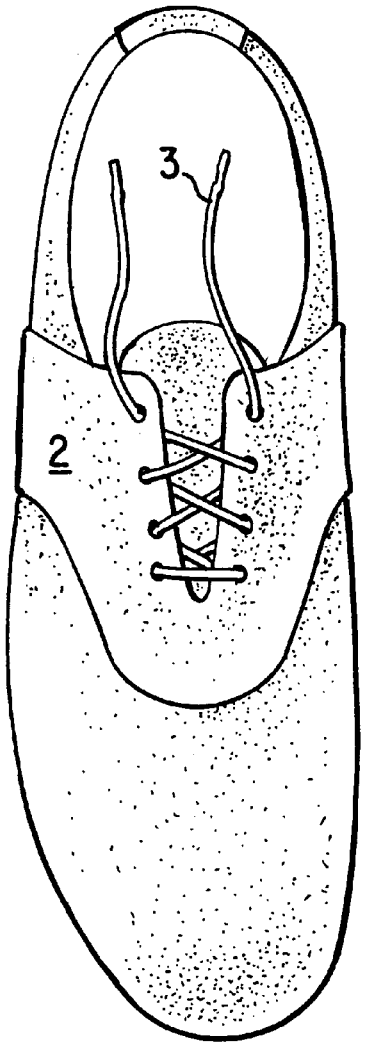
FIG. 4 is a top view of another embodiment of the shoe and removable spat according to the present invention.

FIG. 4 illustrates another embodiment of the invention. In this embodiment, both spat 2 and upper 5 are provided with eyelets 10 for shoelace 3. Although this embodiment is slightly more difficult to replace due to the necessity of aligning the eyelets in upper 5 and spat 2, the arrangement provides a very secure fit of the spat to the upper.

Figure 5:
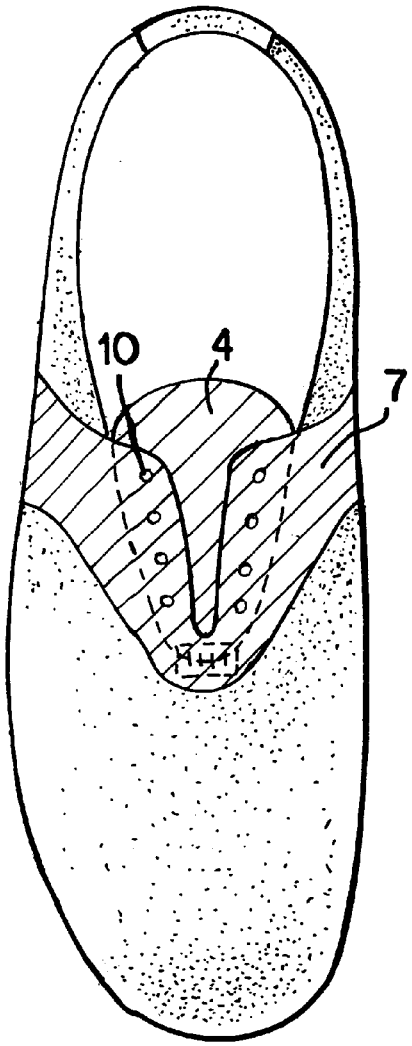
FIG. 5 is a top view of the shoe shown in FIG. 4 with the spat removed.
Figure 6A:
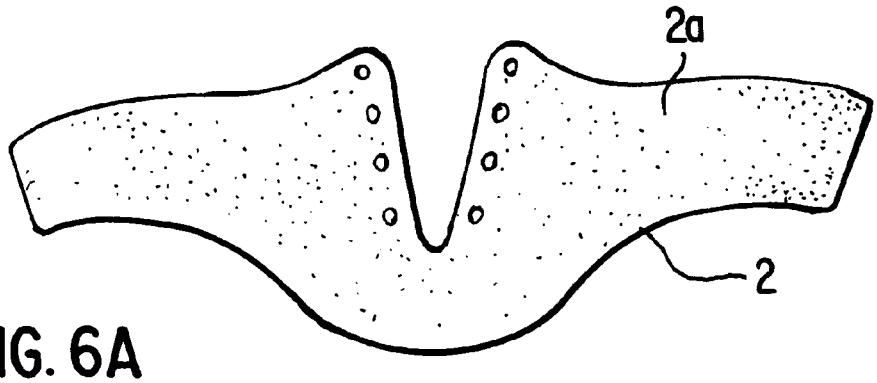
FIG. 6A is a top view of the front side of the removable spat.
Figure 6B:
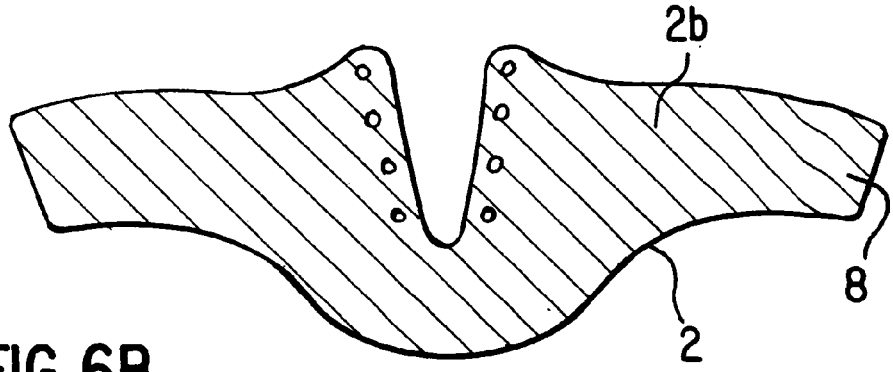
FIG. 6B is a top view of the back side of the removable spat.

FIG. 5 illustrates an arrangement where tongue 4 is attached to the upper 5. Attachment of tongue 4 to upper 5 can be by any of the above-described means. Tongue 4 has an upper surface being provided with the first attachment media as described above and which cover spat area 7. As illustrated in FIGS. 6A and 6B, spat 2 is of similar construction as the previously described embodiment, however, there is no tongue on this spat. Spat 2 has a front side 2*a* and a backside 2*b*. Backside 2*b* is provided on substantially its entire area with the second attachment media 8. Spat 2 is placed on upper 5 in the same manner as described above.

Figure 7A:
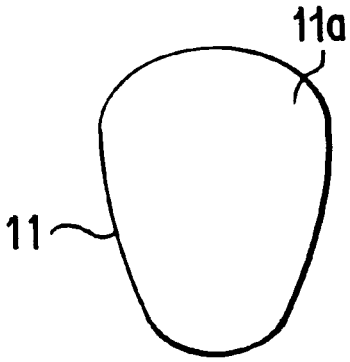
FIG. 7A is a top view of a front side of the removable tongue portion.
Figure 7B:
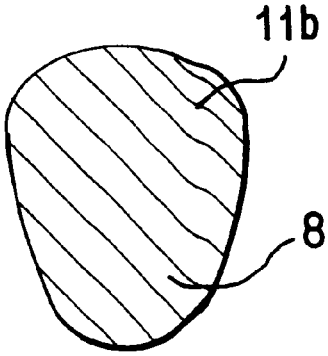
FIG. 7B is a top view of a back side of the removable tongue portion.

As shown in FIGS. 7A and 7B, because tongue 4 is part of upper 5, it must also be capable of having a replaceable upper surface that matches the selected spat 2. Accordingly, a replaceable tongue cover 11 is provided. Tongue cover 11 has an upper side 11*a* and a backside 11*b*. Front side 11*a* is adapted to be colored or have a design that matches a corresponding spat front side 2*a*. Back side 11*b* is covered about substantially its entire area with second attachment media 8. When spat 2 is replaced in this embodiment, tongue cover 11 is similarly replaced with a matching version according to the selected spat. As such, a matching set of spat and tongues can be arranged on shoe 1.

Figure 8A:
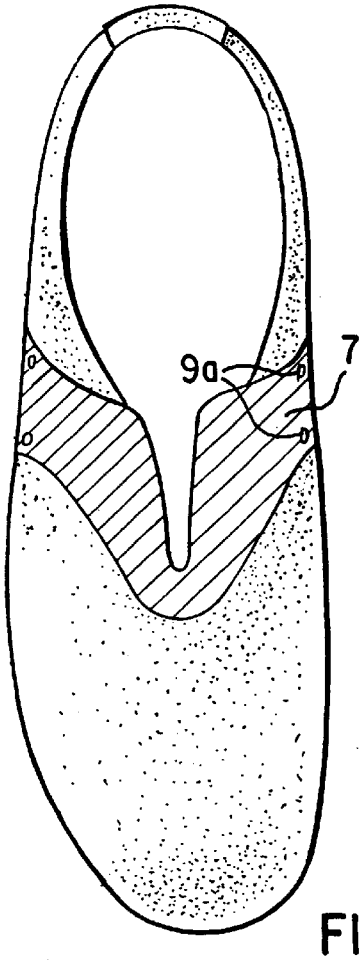
FIGS. 8A and 8B are top views of another embodiment of the shoe and removable spat according to the present invention.
Figure 8B:
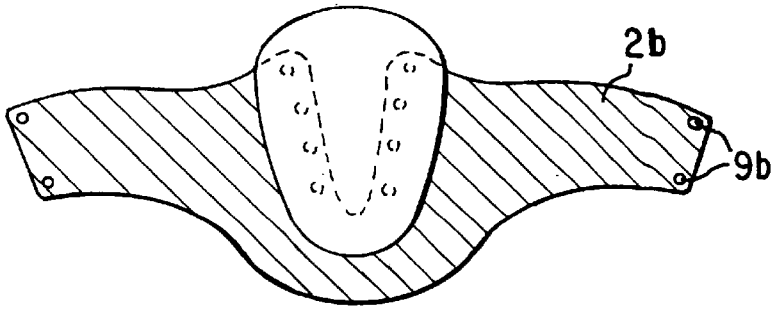

FIGS. 8A and 8B illustrate a further embodiment of the present invention. As seen in FIG. 8A, spat area 7 is provided with an additional securing mechanism 9*a*. Similarly, as seen in FIG. 8B, spat backside 2*b* of spat 2 is provided with corresponding securing mechanism 9*b*. These securing mechanisms are provided in addition to the first and second attachment media to additionally secure spat 2 on upper portion 5. This embodiment is especially useful when eyelets 10 are only formed in spat 2. As noted above, in this arrangement, force applied to the mating surfaces of spat 2 and upper 5 when the shoelaces are tightened tends to pull the surfaces apart. Additional securing mechanisms 9*a* and 9*b* assist in maintaining the spat on the upper against this force, thereby providing additional securement. However, securing mechanisms 9*a* and 9*b* could also be used on the embodiment of spat 2 illustrated in FIG. 4. In addition, FIGS. 8A and 8B illustrate the securing mechanisms 9*a* and 9*b* as corresponding snaps. Other types of additional securing mechanisms are also contemplated in the present invention, such as a tongue and groove arrangement, zipper, etc.

With respect to the above description, it is to be realized that the optimum dimensional relationships for the parts of the invention may include variations in size, materials, shape, form, function and manner of operation, assembly and use. For instance, the area below groove 4*a* on spat area 7 and spat 2 is generally about one eighth of an inch wide. However, this area could be increased for additional securement to about a half an inch and also include a snap. Other variations would be deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. Footwear, comprising:

a shoe having a tongueless upper portion with a spat area, and a tongue groove being formed in the spat area of the upper portion, the spat area being substantially covered with a first attachment media;

a removable combined spat and tongue having a second attachment media substantially covering an underside of the spat, such that when the combined spat and tongue are placed on the spat area of the upper portion, the first and second attachment media are overlaid to secure the spat on the shoe, and the tongue is fitted into the tongue groove; and wherein a shoe tightener is arranged only on the spat, the shoe tightener operable to secure the shoe to a foot.

2. Footwear according to claim 1, wherein the shoe tightener includes eyelets arranged only on the spat, said eyelets being operable with shoelaces to secure the shoe to the foot.

3. Footwear according to claim 2, wherein the tongue is secured in an end region to the underside of the spat to form the combined tongue and spat.

4. Footwear according to claim 3, wherein the first and second attachment media are a loop and hook material.

5. Footwear according to claim 2, wherein the first and second attachment media are a loop and hook material.

6. Footwear according to claim 2, wherein the spat area covered with the first attachment media is recessed into the upper portion, such that an outer surface of the combined spat and tongue is substantially flush with an outer surface of the upper portion when attached via the first and second attachment media.

7. Footwear according to claim 1, wherein the tongue is secured in an end region to the underside of the spat to form the combined tongue and spat.

8. Footwear according to claim 7, wherein the first and second attachment media are a loop and hook material.

9. Footwear according to claim 7, wherein the spat area covered with the first attachment media is recessed into the upper portion, such that an outer surface of the combined spat and tongue is substantially flush with an outer surface of the upper portion when attached via the first and second attachment media.

10. Footwear according to claim 1, wherein the first and second attachment media are a loop and hook material.

11. Footwear according to claim 10, wherein the spat area covered with the first attachment media is recessed into the upper portion, such that an outer surface of the combined spat and tongue is substantially flush with an outer surface of the upper portion when attached via the first and second attachment media.

12. Footwear according to claim 2, wherein the spat area covered with the first attachment media is recessed into the upper portion, such that an outer surface of the combined spat and tongue is substantially flush with an outer surface of the upper portion when attached via the first and second attachment media.

13. Footware according to claim 1, wherein an area below a tongue groove on the upper portion and a corresponding area on the spat have a width of about one half of an inch.

14. Footwear according to claim 1, wherein an area below a tongue groove on the upper portion and a corresponding area on the spat have a width of about one eighth of an inch.

15. Footwear according to claim 1, wherein the shoe is a golf shoe.

16. Footwear, comprising:

a shoe having a tongueless upper portion with a spat area, and a tongue groove being formed in the spat area of the upper portion, the spat area including a first attachment media;

a removable combined spat and tongue including a second attachment media on an underside of the spat, such that when the combined spat and tongue are placed on the spat area of the upper portion, the first and second attachment media secure the spat on the shoe, and the tongue is fitted into the tongue groove; and wherein a shoe tightener is arranged only on the spat, the shoe tightener being operable to secure the shoe to a foot.

17. Footwear according to claim 16, wherein the first and second attachment media cover a substantial portion of the respective spat area and underside of the spat.

18. Footwear according to claim 16, wherein the shoe tightener includes eyelets arranged only on the spat, said eyelets being operable with shoelaces to secure the shoe to the foot.

19. Footwear according to claim 16, wherein the tongue is secured in an end region to the underside of the spat to form the combined tongue and spat.

20. Footwear according to claim 16, wherein the first and second attachment media are a loop and hook material.

* * * * *